US007793719B2

(12) United States Patent
Snider et al.

(10) Patent No.: US 7,793,719 B2
(45) Date of Patent: Sep. 14, 2010

(54) TOP DRIVE CASING SYSTEM

(75) Inventors: Randy Gene Snider, Houston, TX (US); David Othman Shahin, Houston, TX (US); John Timothy Allen, Katy, TX (US); Kevin Leon Gray, Friendswood, TX (US); Gary Thompson, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/932,619

(22) Filed: Oct. 31, 2007

(65) Prior Publication Data

US 2008/0110637 A1 May 15, 2008

Related U.S. Application Data

(63) Continuation of application No. 10/389,483, filed on Mar. 14, 2003, now Pat. No. 7,712,523, which is a continuation of application No. 09/550,721, filed on Apr. 17, 2000, now Pat. No. 6,536,520.

(51) Int. Cl.
*E21B 19/16* (2006.01)

(52) U.S. Cl. ..... 166/250.01; 166/66; 166/77.51; 166/380

(58) Field of Classification Search ..... 175/40; 166/250.01, 78.1, 77.51, 77.53, 66
See application file for complete search history.

(56) References Cited

U.S. PATENT DOCUMENTS

| | | | |
|---|---|---|---|
| 179,973 | A | 7/1876 | Thornton |
| 1,414,207 | A | 4/1922 | Reed |
| 1,418,766 | A | 6/1922 | Wilson |
| 1,518,634 | A | 12/1924 | Cason, Jr. |
| 1,585,069 | A | 5/1926 | Youle |
| 1,708,378 | A | 4/1929 | Dale |
| 1,728,136 | A | 9/1929 | Power |
| 1,777,592 | A | 10/1930 | Thomas |
| 1,805,007 | A | 5/1931 | Pedley |

(Continued)

FOREIGN PATENT DOCUMENTS

| | | |
|---|---|---|
| CA | 2 307 386 | 11/2000 |

(Continued)

OTHER PUBLICATIONS

"First Success with Casing-Drilling" World Oil, Feb. (1999), pp. 25.

(Continued)

*Primary Examiner*—Hoang Dang
(74) *Attorney, Agent, or Firm*—Patterson & Sheridan, LLP

(57) ABSTRACT

A torque head for gripping tubular members, in at least some aspects, has a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable.

20 Claims, 12 Drawing Sheets

U.S. PATENT DOCUMENTS

| | | | |
|---|---|---|---|
| 1,825,026 | A | 9/1931 | Thomas |
| 1,842,638 | A | 1/1932 | Wigle |
| 1,917,135 | A | 7/1933 | Littell |
| 2,105,885 | A | 1/1938 | Hinderliter |
| 2,128,430 | A | 8/1938 | Pryor |
| 2,167,338 | A | 7/1939 | Murcell |
| 2,184,681 | A | 12/1939 | Osmun et al. |
| 2,214,429 | A | 9/1940 | Miller |
| 2,414,719 | A | 1/1947 | Cloud |
| 2,522,444 | A | 9/1950 | Grable |
| 2,536,458 | A | 1/1951 | Munsinger |
| 2,570,080 | A | 10/1951 | Stone |
| 2,582,987 | A | 1/1952 | Hagenbook |
| 2,595,902 | A | 5/1952 | Stone |
| 2,610,690 | A | 9/1952 | Beatty |
| 2,641,444 | A | 6/1953 | Moon |
| 2,668,689 | A | 2/1954 | Cormany |
| 2,692,059 | A | 10/1954 | Bolling, Jr. |
| 2,953,406 | A | 9/1960 | Young |
| 2,965,177 | A | 12/1960 | Bus, Sr. et al. |
| 3,041,901 | A | 7/1962 | Knights |
| 3,087,546 | A | 4/1963 | Wooley |
| 3,122,811 | A | 3/1964 | Gilreath |
| 3,191,683 | A | 6/1965 | Alexander |
| 3,193,116 | A | 7/1965 | Kenneday et al. |
| 3,266,582 | A | 8/1966 | Homanick |
| 3,302,496 | A | 2/1967 | Mitchell et al. |
| 3,305,021 | A | 2/1967 | Lebourg |
| 3,321,018 | A | 5/1967 | McGill |
| 3,349,455 | A | 10/1967 | Doherty |
| 3,368,396 | A | 2/1968 | Burkleo et al. |
| 3,380,528 | A | 4/1968 | Timmons |
| 3,392,609 | A | 7/1968 | Bartos |
| 3,420,344 | A | 1/1969 | Hilpert et al. |
| 3,477,527 | A | 11/1969 | Koot |
| 3,489,220 | A | 1/1970 | Kinley |
| 3,511,349 | A | 5/1970 | Herscovici |
| 3,518,903 | A | 7/1970 | Ham et al. |
| 3,548,936 | A | 12/1970 | Kilgore et al. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,566,505 | A | 3/1971 | Martin |
| 3,570,598 | A | 3/1971 | Johnson |
| 3,602,302 | A | 8/1971 | Kluth |
| 3,606,664 | A | 9/1971 | Weiner |
| 3,635,105 | A | 1/1972 | Dickmann et al. |
| 3,638,989 | A | 2/1972 | Sandquist |
| 3,662,842 | A | 5/1972 | Bromell |
| 3,680,412 | A | 8/1972 | Mayer et al. |
| 3,691,825 | A | 9/1972 | Dyer |
| 3,697,113 | A | 10/1972 | Palauro et al. |
| 3,700,048 | A | 10/1972 | Desmoulins |
| 3,706,347 | A | 12/1972 | Brown |
| 3,722,331 | A | 3/1973 | Radulescu |
| 3,745,820 | A | 7/1973 | Weiner |
| 3,746,330 | A | 7/1973 | Taciuk |
| 3,747,675 | A | 7/1973 | Brown |
| 3,766,991 | A | 10/1973 | Brown |
| 3,776,320 | A | 12/1973 | Brown |
| 3,780,883 | A | 12/1973 | Brown |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,871,618 | A | 3/1975 | Funk |
| 3,881,375 | A | 5/1975 | Kelly |
| 3,885,679 | A | 5/1975 | Swoboda, Jr. et al. |
| 3,893,556 | A | 7/1975 | Lech, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,961,399 | A | 6/1976 | Boyadjieff |
| 3,964,552 | A | 6/1976 | Slator |
| 3,980,143 | A | 9/1976 | Swartz et al. |
| 4,008,773 | A | 2/1977 | Wallace et al. |
| 4,054,332 | A | 10/1977 | Bryan, Jr. |
| 4,077,525 | A | 3/1978 | Callegari et al. |
| 4,091,451 | A | 5/1978 | Weiner et al. |
| 4,100,968 | A | 7/1978 | Delano |
| 4,106,176 | A | 8/1978 | Rice et al. |
| 4,125,040 | A | 11/1978 | True |
| 4,127,927 | A | 12/1978 | Hauk et al. |
| 4,142,739 | A | 3/1979 | Billingsley |
| 4,176,436 | A | 12/1979 | McCombs et al. |
| 4,199,032 | A | 4/1980 | Weiner et al. |
| 4,202,225 | A | 5/1980 | Sheldon et al. |
| 4,221,269 | A | 9/1980 | Hudson |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,280,380 | A | 7/1981 | Eshghy |
| 4,315,553 | A | 2/1982 | Stallings |
| 4,320,915 | A | 3/1982 | Abbott et al. |
| 4,365,402 | A | 12/1982 | McCombs et al. |
| 4,401,000 | A | 8/1983 | Kinzbach |
| 4,437,363 | A | 3/1984 | Haynes |
| 4,440,220 | A | 4/1984 | McArthur |
| 4,446,745 | A | 5/1984 | Stone et al. |
| 4,449,596 | A | 5/1984 | Boyadjieff |
| 4,472,002 | A | 9/1984 | Beney et al. |
| RE31,699 | E | 10/1984 | Eckel |
| 4,489,794 | A | 12/1984 | Boyadjieff |
| 4,492,134 | A | 1/1985 | Reinhldt et al. |
| 4,494,424 | A | 1/1985 | Bates |
| 4,515,045 | A | 5/1985 | Gnatchenko et al. |
| 4,529,045 | A | 7/1985 | Boyadjieff et al. |
| 4,561,529 | A | 12/1985 | McIntosh |
| 4,570,706 | A | 2/1986 | Pugnet |
| 4,573,359 | A | 3/1986 | Carstensen |
| 4,592,125 | A | 6/1986 | Skene |
| 4,593,584 | A | 6/1986 | Neves |
| 4,593,773 | A | 6/1986 | Skeie |
| 4,604,724 | A | 8/1986 | Shaginian et al. |
| 4,604,818 | A | 8/1986 | Inoue |
| 4,605,077 | A | 8/1986 | Boyadjieff |
| 4,613,161 | A | 9/1986 | Brisco |
| 4,625,796 | A | 12/1986 | Boyadjieff |
| 4,643,259 | A | 2/1987 | Zeringue, Jr. |
| 4,646,827 | A | 3/1987 | Cobb |
| 4,649,777 | A | 3/1987 | Buck |
| 4,652,195 | A | 3/1987 | McArthur |
| 4,667,752 | A | 5/1987 | Berry et al. |
| 4,676,312 | A | 6/1987 | Mosing et al. |
| 4,681,158 | A | 7/1987 | Pennison |
| 4,681,162 | A | 7/1987 | Boyd |
| 4,682,678 | A | 7/1987 | Kussel et al. |
| 4,683,962 | A | 8/1987 | True |
| 4,686,873 | A | 8/1987 | Lang et al. |
| 4,709,599 | A | 12/1987 | Buck |
| 4,709,766 | A | 12/1987 | Boyadjieff |
| 4,715,451 | A | 12/1987 | Bseisu et al. |
| 4,725,179 | A | 2/1988 | Woolslayer et al. |
| 4,735,270 | A | 4/1988 | Fenyvesi |
| 4,738,145 | A | 4/1988 | Vincent et al. |
| 4,742,876 | A | 5/1988 | Barthelemy et al. |
| 4,759,239 | A | 7/1988 | Hamilton et al. |
| 4,762,187 | A | 8/1988 | Haney |
| 4,765,401 | A | 8/1988 | Boyadjieff |
| 4,765,416 | A | 8/1988 | Bjerking et al. |
| 4,773,689 | A | 9/1988 | Wolters |

4,781,359 A 11/1988 Matus
4,791,997 A 12/1988 Krasnov
4,793,422 A 12/1988 Krasnov
4,800,968 A 1/1989 Shaw et al.
4,813,493 A 3/1989 Shaw et al.
4,813,495 A 3/1989 Leach
4,821,814 A 4/1989 Willis et al.
4,832,552 A 5/1989 Skelly
4,836,064 A 6/1989 Slator
4,843,945 A 7/1989 Dinsdale
4,854,383 A 8/1989 Arnold et al.
4,867,236 A 9/1989 Haney et al.
4,875,530 A 10/1989 Frink et al.
4,878,546 A 11/1989 Shaw et al.
4,899,816 A 2/1990 Mine
4,909,741 A 3/1990 Schasteen et al.
4,921,386 A 5/1990 McArthur
4,936,382 A 6/1990 Thomas
4,938,109 A 7/1990 Torres et al.
4,962,579 A 10/1990 Moyer et al.
4,962,819 A 10/1990 Bailey et al.
4,971,146 A 11/1990 Terrell
4,979,356 A 12/1990 Vatne
4,997,042 A 3/1991 Jordan et al.
5,022,472 A 6/1991 Bailey et al.
5,036,927 A 8/1991 Willis
5,044,232 A 9/1991 Schulze-Beckinghausen
5,049,020 A 9/1991 McArthur
5,050,691 A 9/1991 Moses
5,060,542 A 10/1991 Hauk
5,062,756 A 11/1991 McArthur et al.
5,081,888 A 1/1992 Schulze-Beckinghausen
5,083,356 A 1/1992 Gonzalez et al.
5,107,940 A 4/1992 Berry
5,111,893 A 5/1992 Kvello-Aune
RE34,063 E 9/1992 Vincent et al.
5,144,298 A 9/1992 Henneuse
5,150,642 A 9/1992 Moody et al.
5,159,860 A 11/1992 Pietras
5,161,438 A 11/1992 Pietras
5,191,939 A 3/1993 Stokley
5,199,542 A 4/1993 Flotow
5,202,681 A 4/1993 Dublin, Jr. et al.
5,207,128 A 5/1993 Albright
5,233,742 A 8/1993 Gray et al.
5,245,265 A 9/1993 Clay
5,245,877 A 9/1993 Ruark
5,251,709 A 10/1993 Richardson
5,255,751 A 10/1993 Stogner
5,259,275 A 11/1993 Schulze-Beckinghausen
5,261,517 A 11/1993 Hering
5,272,925 A 12/1993 Henneuse et al.
5,282,653 A 2/1994 LaFleur et al.
5,284,210 A 2/1994 Helms et al.
5,294,228 A 3/1994 Willis et al.
5,297,833 A 3/1994 Willis et al.
5,305,839 A 4/1994 Kalsi et al.
5,323,852 A 6/1994 Cornette et al.
5,332,043 A 7/1994 Ferguson
5,340,182 A 8/1994 Busink et al.
5,347,859 A 9/1994 Henneuse et al.
5,351,767 A 10/1994 Stogner et al.
5,354,150 A 10/1994 Canales
5,368,113 A 11/1994 Schulze-Beckinghausen
5,386,733 A 2/1995 Hesthamar et al.
5,386,746 A 2/1995 Hauk
5,388,651 A 2/1995 Berry
5,390,568 A 2/1995 Pietras
5,402,688 A 4/1995 Okada et al.
5,433,279 A 7/1995 Tassari et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,538,121 A 7/1996 Hering
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,667,026 A 9/1997 Lorenz et al.
5,667,045 A 9/1997 Cummings, III
5,689,871 A 11/1997 Carstensen
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,947,214 A 9/1999 Tibbitts
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,018,136 A 1/2000 Ohmi et al.
6,056,060 A 5/2000 Abrahamsen et al.
6,065,550 A 5/2000 Gardes
6,070,500 A 6/2000 Dlask et al.
6,079,509 A 6/2000 Bee et al.
6,082,224 A 7/2000 McDaniels et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,189,621 B1 2/2001 Vail, III
6,199,641 B1 3/2001 Downie et al.
6,202,764 B1 3/2001 Ables et al.
6,217,258 B1 4/2001 Yamamoto et al.
6,227,587 B1 5/2001 Terral
6,237,684 B1 5/2001 Bouligny, Jr. et al.
6,276,450 B1 8/2001 Seneviratne
6,279,654 B1 8/2001 Mosing et al.
6,309,002 B1 10/2001 Bouligny
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,374,706 B1 4/2002 Newman
6,378,630 B1 4/2002 Ritorto et al.
6,385,837 B1 5/2002 Murakami et al.
6,390,190 B2 5/2002 Mullins
6,412,554 B1 7/2002 Allen et al.
6,415,862 B1 7/2002 Mullins
6,431,626 B1 8/2002 Bouligny
6,435,280 B1 8/2002 Van Wechem et al.
6,443,241 B1 9/2002 Juhasz et al.
6,527,047 B1 3/2003 Pietras

| | | | |
|---|---|---|---|
| 6,527,493 | B1 | 3/2003 | Kamphorst et al. |
| 6,536,520 | B1 | 3/2003 | Snider et al. |
| 6,553,825 | B1 | 4/2003 | Boyd |
| 6,571,868 | B2 | 6/2003 | Victor |
| 6,591,471 | B1 | 7/2003 | Hollingsworth et al. |
| 6,595,288 | B2 | 7/2003 | Mosing et al. |
| 6,622,796 | B1 | 9/2003 | Pietras |
| 6,637,526 | B2 | 10/2003 | Juhasz et al. |
| 6,651,737 | B2 | 11/2003 | Bouligny |
| 6,668,684 | B2 | 12/2003 | Allen et al. |
| 6,668,937 | B1 | 12/2003 | Murray |
| 6,679,333 | B2 | 1/2004 | York et al. |
| 6,688,394 | B1 | 2/2004 | Ayling |
| 6,688,398 | B2 | 2/2004 | Pietras |
| 6,691,801 | B2 | 2/2004 | Juhasz et al. |
| 6,695,559 | B1 | 2/2004 | Pietras |
| 6,705,405 | B1 | 3/2004 | Pietras |
| 6,725,938 | B1 | 4/2004 | Pietras |
| 6,725,949 | B2 | 4/2004 | Seneviratne |
| 6,732,822 | B2 | 5/2004 | Slack et al. |
| 6,742,584 | B1 | 6/2004 | Appleton |
| 6,742,596 | B2 | 6/2004 | Haugen |
| 6,832,656 | B2 | 12/2004 | Chandran et al. |
| 6,832,658 | B2 | 12/2004 | Keast |
| 6,840,322 | B2 | 1/2005 | Haynes |
| 6,892,835 | B2 | 5/2005 | Shahin et al. |
| 6,896,055 | B2 | 5/2005 | Koithan |
| 6,907,934 | B2 | 6/2005 | Kauffman et al. |
| 6,938,697 | B2 | 9/2005 | Haugen |
| 6,976,298 | B1 | 12/2005 | Pietras |
| 6,994,176 | B2 | 2/2006 | Shahin et al. |
| 7,004,259 | B2 | 2/2006 | Pietras |
| 7,028,585 | B2 | 4/2006 | Pietras et al. |
| 7,028,586 | B2 | 4/2006 | Robichaux |
| 7,044,241 | B2 | 5/2006 | Angman |
| 7,073,598 | B2 | 7/2006 | Haugen |
| 7,090,021 | B2 | 8/2006 | Pietras |
| 7,096,977 | B2 | 8/2006 | Juhasz et al. |
| 7,100,698 | B2 | 9/2006 | Kracik et al. |
| 7,107,875 | B2 | 9/2006 | Haugen et al. |
| 7,117,938 | B2 | 10/2006 | Hamilton et al. |
| 7,128,161 | B2 | 10/2006 | Pietras |
| 7,140,443 | B2 | 11/2006 | Beierbach et al. |
| 7,140,445 | B2 | 11/2006 | Shahin et al. |
| 7,188,686 | B2 | 3/2007 | Folk et al. |
| 7,191,840 | B2 | 3/2007 | Pietras et al. |
| 7,213,656 | B2 | 5/2007 | Pietras |
| 7,264,050 | B2 | 9/2007 | Koithan et al. |
| 7,281,587 | B2 | 10/2007 | Haugen |
| 7,296,623 | B2 | 11/2007 | Koithan et al. |
| 7,325,610 | B2 | 2/2008 | Giroux et al. |
| 2001/0042625 | A1 | 11/2001 | Appleton |
| 2002/0108748 | A1 | 8/2002 | Keyes |
| 2003/0164276 | A1 | 9/2003 | Snider et al. |
| 2003/0173073 | A1 | 9/2003 | Snider et al. |
| 2003/0178847 | A1 | 9/2003 | Galle, Jr. et al. |
| 2004/0003490 | A1 | 1/2004 | Shahin et al. |
| 2005/0000691 | A1 | 1/2005 | Giroux et al. |
| 2005/0051343 | A1 | 3/2005 | Pietras |
| 2006/0000600 | A1 | 1/2006 | Pietras |
| 2006/0124353 | A1 | 6/2006 | Juhasz et al. |
| 2006/0180315 | A1 | 8/2006 | Shahin et al. |
| 2007/0000668 | A1 | 1/2007 | Christensen |

FOREIGN PATENT DOCUMENTS

| | | |
|---|---|---|
| DE | 3 523 221 | 2/1987 |
| EP | 0 087 373 | 8/1983 |
| EP | 0 162 000 | 11/1985 |
| EP | 0 171 144 | 2/1986 |
| EP | 0 285 386 | 10/1988 |
| EP | 0 474 481 | 3/1992 |
| EP | 1148206 | 10/2001 |
| EP | 1 256 691 | 11/2002 |
| GB | 2 049 518 | 12/1980 |
| GB | 2 053 088 | 2/1981 |
| GB | 2 099 620 | 12/1982 |
| GB | 2 115 940 | 9/1983 |
| GB | 2 224 481 | 9/1990 |
| GB | 2 275 486 | 4/1993 |
| GB | 2 357 530 | 6/2001 |
| JP | 2001/173349 | 6/2001 |
| WO | WO 93-07358 | 4/1993 |
| WO | WO 93/18276 | 9/1993 |
| WO | WO 96-18799 | 6/1996 |
| WO | WO 97-08418 | 3/1997 |
| WO | WO 98-05844 | 2/1998 |
| WO | WO 98-32948 | 7/1998 |
| WO | WO 99-11902 | 3/1999 |
| WO | WO 99-58810 | 11/1999 |
| WO | WO 00-08293 | 2/2000 |
| WO | WO 00-09853 | 2/2000 |
| WO | WO 00-50730 | 8/2000 |
| WO | WO 00/52297 | 9/2000 |
| WO | WO 01-33033 | 5/2001 |
| WO | WO 2004-022903 | 3/2004 |
| WO | WO 2005/090740 | 9/2005 |

OTHER PUBLICATIONS

Laurent, et al., "A New Generation Drilling Rig: Hydraulically Powered and Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves to More Challenging Application," AADE Paper 01-NC-HO-32, AADE National Drilling Conference, Mar. 27-29, 2001, pp. 1-10.

Fontenot, et al., "New Rig Design Enhances Casing Drilling Operations in Lobo Trend," paper WOCD-0306-04, World Oil Casing Drilling Technical Conference, Mar. 6-7, 2003, pp. 1-13.

Vincent, et al., "Liner and Casing Drilling—Case Histories and Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving the Market?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

Bickford L Dennis and Mark J. Mabile, Casing Drilling Rig Selection for Stratton Field, Texas, World Oil, vol. 226, No. 3, Mar. 2005.

G H. Kamphorst, G. L. Van Wechem, W. Boom, D. Bottger, and K. Koch, Casing Running Tool, SPE/IADC 52770.

John Doyle, et al., Basic Concepts, MacMillan Publishing Co., 1990, Chapter 3, pp. 31-44 and pp. 209-212.

Portable Top Drive Drilling System, Tesco Drilling Technology, 1994, TESWFT0000693—TESWFT0000736.
EP Search Report, Application No. 06100988.2-2315, dated Jun. 7, 2006.
Prosecution History for U.S. Appl. No. 10/389,483 from Mar. 14, 2003-Aug. 24, 2009, including the following: Response to Office Action dated Apr. 13, 2009, Office Action dated Apr. 13, 2009, Preliminary Amendment submitted with RCE dated Oct. 14, 2008, Response to Office Action dated Nov. 2, 2007, Office Action dated Nov. 2, 2007, Response to Office Action dated Apr. 19, 2007, Office Action dated Apr. 19, 2007, Response to Office Action dated Aug. 25, 2006, Office Action dated Aug. 25, 2006, Response to Restriction Requirement dated Apr. 13, 2006, Restriction Requirement dated Apr. 13, 2006, Examiner Interview Summary Record dated Feb. 7, 2006, Amendment filed with RCE dated Feb. 1, 2006, Request For Continued Examination dated Feb. 1, 2006, Final Office Action dated Jun. 16, 2005, Response to Non-Compliant Amendment dated Mar. 3, 2005, Miscellaneous Action with SSP dated Mar. 3, 2005, Response to Office Action dated Aug. 12, 2004, Examiner Interview Summary Record dated Dec. 9, 2004, Non-Final Office Action dated Aug. 12, 2004, Response to Office Action dated Mar. 31, 2004, Office Action dated Mar. 31, 2004, Response to Restriction Requirement dated Dec. 3, 2003, Restriction Requirement dated Dec. 3, 2003, Preliminary Amendment dated Oct. 27, 2003.

TOP DRIVE CASING SYSTEM

CROSS-REFERENCE TO RELATED APPLICATIONS

This application is a continuation of U.S. patent application Ser. No. 10/389,483, filed Mar. 14, 2003 now U.S. Pat. No. 7,712,523, which is a continuation of U.S. patent application Ser. No. 09/550,721, filed Apr. 17, 2000, now U.S. Pat. No. 6,536,520. The aforementioned related patent applications are herein incorporated by reference in its entirety.

BACKGROUND OF THE INVENTION

1. Field of the Invention

The present invention is directed to wellbore operations, top drives, top drive casing systems and operations, torque heads, top drives with torque heads, and methods using them.

2. Description of the Related Art

The prior art discloses many systems and methods for running casing. The prior art also discloses a variety of systems using a top drive for running casing. Certain prior art top drive systems include the attachment of a spider (e.g. but not limited to, a flush mounted spider) suspended beneath a top drive from the bails.

The bails are then rigidly fastened to a top drive quill so as to cause the flush mounted spider to rotate in unison with any rotation of the quill. Engagement of the flush mounted spider's slips with a casing joint or string causes the casing to rotate in coordinated unison with the spider. FIG. 17 shows a prior art top drive in which the collective assembly beneath a bull gear is able to rotate and is collectively referred to as the "pipe handling" or "handler" system. This pipe handling system can be made to slue in coordination with the quill by rigidly affixing the bails to the quill. In certain embodiments of such a system since the top drive's pipe handling system rotates with the tool at all times, rotation is limited to the design speed limit of the system's seals and bearings—about 6 rpm in some cases. This can add many hours to a casing job. The present inventors have recognized that a system is needed that can rotate significantly faster during the spin-in phase of makeup, like a tong and which would only engage a pipe handler to turn the tool after makeup if there is a stuck pipe situation. Another disadvantage with such systems is that by making the torque head the primary hoisting device the cost of the device is increased and also, in many cases, makes it necessary to produce or own different size/tonnage range torque head assemblies to cover both different size ranges and within size ranges, different tonnages. The present inventors have recognized a need for a system that allows a rig to utilize hoisting equipment it already owns for primary hoisting and a system with a torque head that is lighter, i.e. a less expensive device capable of use universally within a size range regardless of tonnage requirements.

With many known prior art devices, apparatuses and systems 10 with which casing is gripped, e.g. by jaws, inserts, or dies, the casing is damaged. Such damage can result in casing which cannot be used. When premium tubulars are required, such damage is very expensive.

There has long been a need for an efficient and effective 15 system and method for running casing (making-up and breaking-out connections) with a top drive. There has long been a need for such a system and method which provides for continuous fluid circulation during running operations. There has long been a need for such a system and method that efficiently and effectively rotates casing and applies downward force on a casing string while the string is being installed in a wellbore.

There has long been a need for such systems and methods which reduce damage to casing. There has long been a need for such a system and method wherein an apparatus that grips casing does not become locked on the casing.

SUMMARY OF THE INVENTION

The present invention, in certain aspects, provides a system with a top drive and its related apparatus, and a torque head connected to and below the top drive in a rig for selectively gripping casing. The present invention, in certain embodiments, discloses a torque head useful in such systems and methods, the torque head with jaws with grip members, including but not limited to, slips, dies, and inserts; and in one particular aspect slips with movable dies or inserts that have some degree of axial freedom with respect to the jaws so that, in one aspect, when the slips first contact the exterior of a casing section the dies or inserts move axially with respect to the casing rather than radially, i.e. initially they do not bite, or bite only minimally, into the casing. Then, as the casing is moved by the top drive slips allow limited vertical movement both upward and downward. This allows the slips, dies or inserts to move upward relative to the slips as they engage the casing and to move downward relative to the slips as they are disengaged from the casing.

In certain embodiments a fluid circulation tool or apparatus is mounted in a torque head according to the present invention. Part of this tool is introduced into the top of a casing joint when the joint is being hoisted and readied for makeup to a casing string. With appropriate sealing packers, the joint is filled with circulation fluid and then moved into position above the casing string. Once makeup commences, circulating fluid is circulated through the joint and to the casing string.

In certain particular embodiments of the present invention relative axial movement of the torque head with respect to a casing joint being gripped by the slips is also made possible by providing a mounting plate assembly that includes bolts holding it together and springs that allow some controlled axial movement of the torque head. With the slips gripping the casing, a torque head barrel is rigidly fixed relative to the casing and if the casing is made up to the string or is gripped at the spider, downward force on the torque head assembly causes the springs located in the top plate to compress and allows for limited axial movement relative to the casing and elevator, provided the elevator slips are engaged on the casing. Such a torque head can be used with the previously mentioned movable dies, etc., (which engage the casing when they are moved axially downwardly relative to the inner diameter of the torque head) and which are disengaged by axial movement upwardly relative to an inner diameter of the torque head. In the event the torque head assembly is subjected to a dangerous axial load of predetermined amount (e.g., but not limited to, about 100 tons or more), the bolts fail before significant damage is done to the torque head. When the bolts fail, the top plate assembly separates from the torque head barrel while the slips of the torque head assembly remain engaged against the casing, thus causing the barrel and slip mechanism within the barrel to remain firmly attached to the casing and prevent it from free falling the rig floor. This also reduces the possibility of items falling down (e.g. the torque head) and injuring personnel.

In certain aspects, selectively controlled piston/cylinder devices are used to move the slips into and out of engagement with a casing joint. In certain embodiments the piston/cylinder assemblies have internal flow control valves and accumulators so that once the slips engage the casing, hydraulic pressure is maintained in the cylinders and the slips remain in engagement with the casing.

Methods according to the present invention with systems 20 according to the present invention are more automated than previous systems because in various prior art systems the torque head can become locked onto the casing when the slips of an elevator (or other suspension/clamping device) are engaged against the casing after the slips of the torque head have been engaged. This condition is a result of the actuation of hydraulic cylinders and then not being able to provide sufficient force to disengage the slips and overcome the mechanical advantage created by the wedging action of slip assemblies without some relative vertical movement of the casing. With the slips of the elevator set, this relative vertical movement of the casing is prevented. The same condition exists for the slips of the elevator in various prior art systems so that the torque head and elevator are locked onto the casing. Various methods are employed to prevent or preclude the torque head from becoming locked onto the casing. In one aspect the dies are capable of some vertical movement relative to the slips. In another aspect in the torque head barrel some limited vertical movement relative to the casing is allowed due to the two-piece construction of the torque head barrel top assembly with incorporated spring washers. When the need to use a power tong to makeup a casing string is eliminated, as with systems according to the present invention, the need for a tong running crew is also eliminated.

It is, therefore, an object of at least certain preferred 10 embodiments of the present invention to provide: New, useful, unique, efficient, and novel and nonobvious system and methods for running casing with a top drive;

Such systems and methods which provide automated operations;

Such systems and methods which provide continuous fluid circulation during operations;

Such systems and methods which reduce or eliminate damage to casing by using grippers with movable dies or inserts (marking or non-marking); that prevent a torquing apparatus from becoming locked onto casing and/or which reduce or eliminate axial loading on a torquing apparatus and/or by providing for shear release of the torque head from an item, e.g. a top drive connected to it.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION OF THE PREFERRED EMBODIMENT

Figure 1:
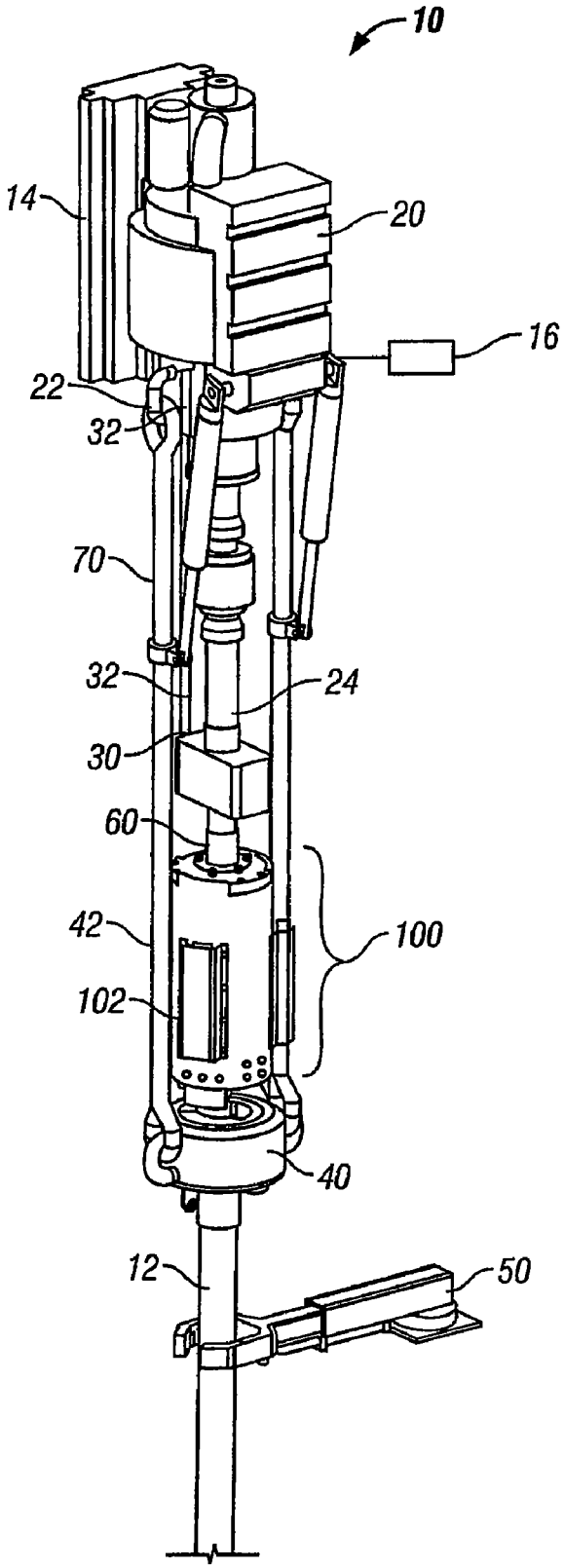
FIG. 1 is a perspective view of a system according to the present invention.
Figure 2:
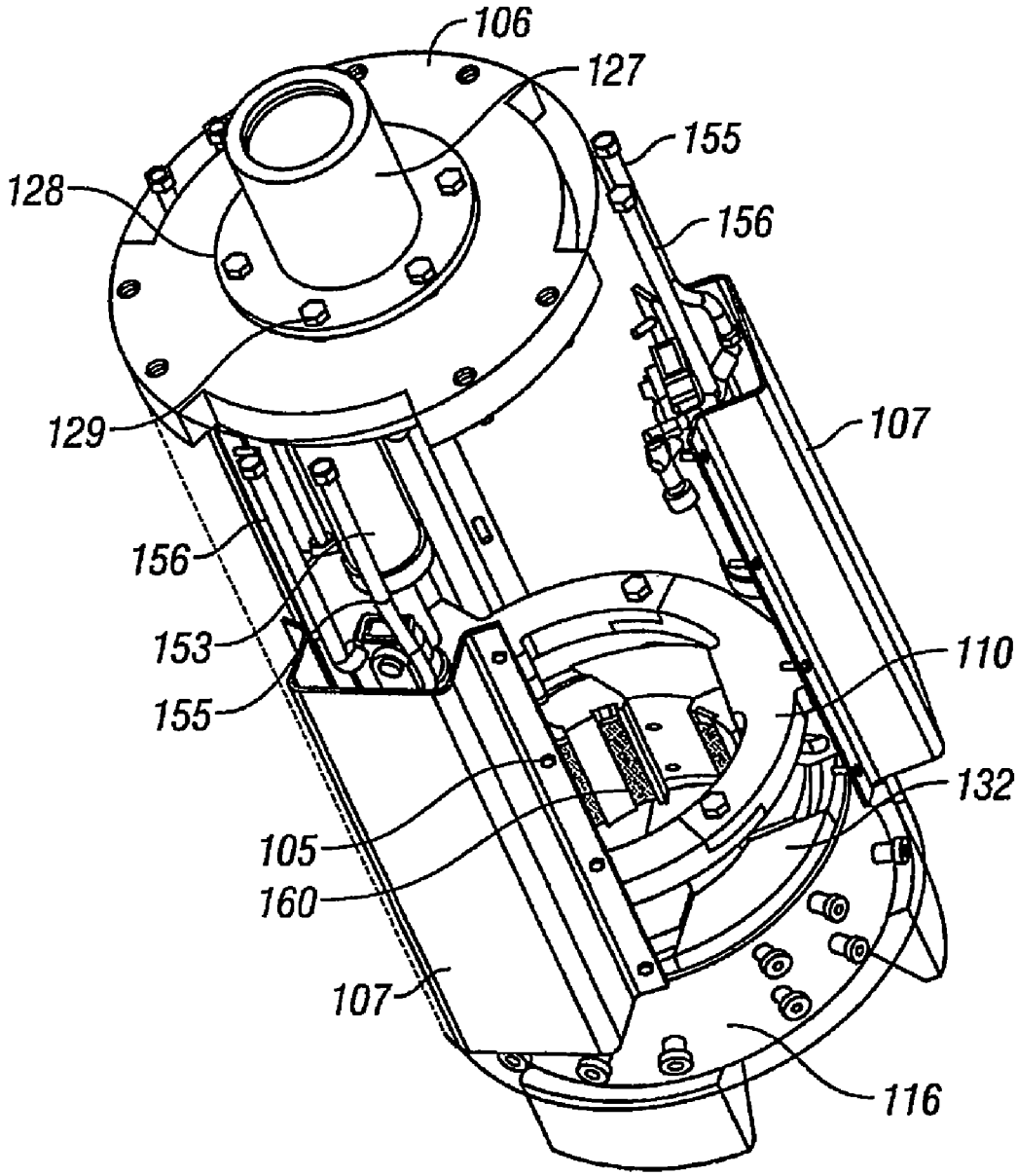
FIG. 2 is a perspective view of a part of a torque head according to the present invention.

Referring now to FIG. 1, a system 10 according to the present invention includes a top drive 20, a torque wrench assembly 30 used for back-up, an elevator 40 (which may also be any suitable known suspendable selective clamping apparatus or device), a pipe handler 50, and a torque head 100. The elevator 40 is suspended by bails 42 from eyes 22 of the top drive 20. The torque wrench assembly 30 is suspended by a support 32 from the top drive 20.

A torque sub 60 interconnects a spindle 24 (also called a "a quill") of the top drive 20 and the top of a joint of casing 12 that extends into the torque head 100. Rotation of the spindle 24 by the top drive 20 rotates the torque sub 60 and the casing joint 12. A top portion of the casing 12 (or of a casing coupling if one is used) extends into the torque head 100.

A selectively operable bail movement apparatus 70 (also called a "pipe handler") moves the bails 42 and elevator 40 as desired. The top drive 20 is movably mounted to part 14 of a rig (not shown). The top drive, top drive controls, torque wrench assembly, torque sub, elevator, bail movement apparatus and pipe handler may be any suitable known apparatuses as have been used, are used, and/or are commercially available.

Preferably the torque head is positioned above the elevator and the torque head is connected to the top drive spindle. In one particular embodiment the spindle or "quill" projects down into a top barrel of the torque head about 5.625 inches. The spindle is threadedly connected to the top of the torque head.

By controlling and selectively rotating the spindle 24 with the top drive 20, hoisting, lowering and torquing of casing is controlled via controls 16 (shown schematically) of the top drive 20. The torque sub 60 is interconnected with and in communication with controls 16 and it monitors torque applied to casing, e.g. during a makeup operation.

With the spindle or quill 24 engaged by the back-up assembly 30, the bails 42, elevator 40, and torque head 100 rotate together, thereby rotating a casing string (not shown) whose top joint is engaged by the torque head 100 while the string is lowered or raised. This is advantageous in the event the casing becomes stuck during setting operations; it is desirable to be able to rotate the casing string while it is being lowered.

Figure 7:
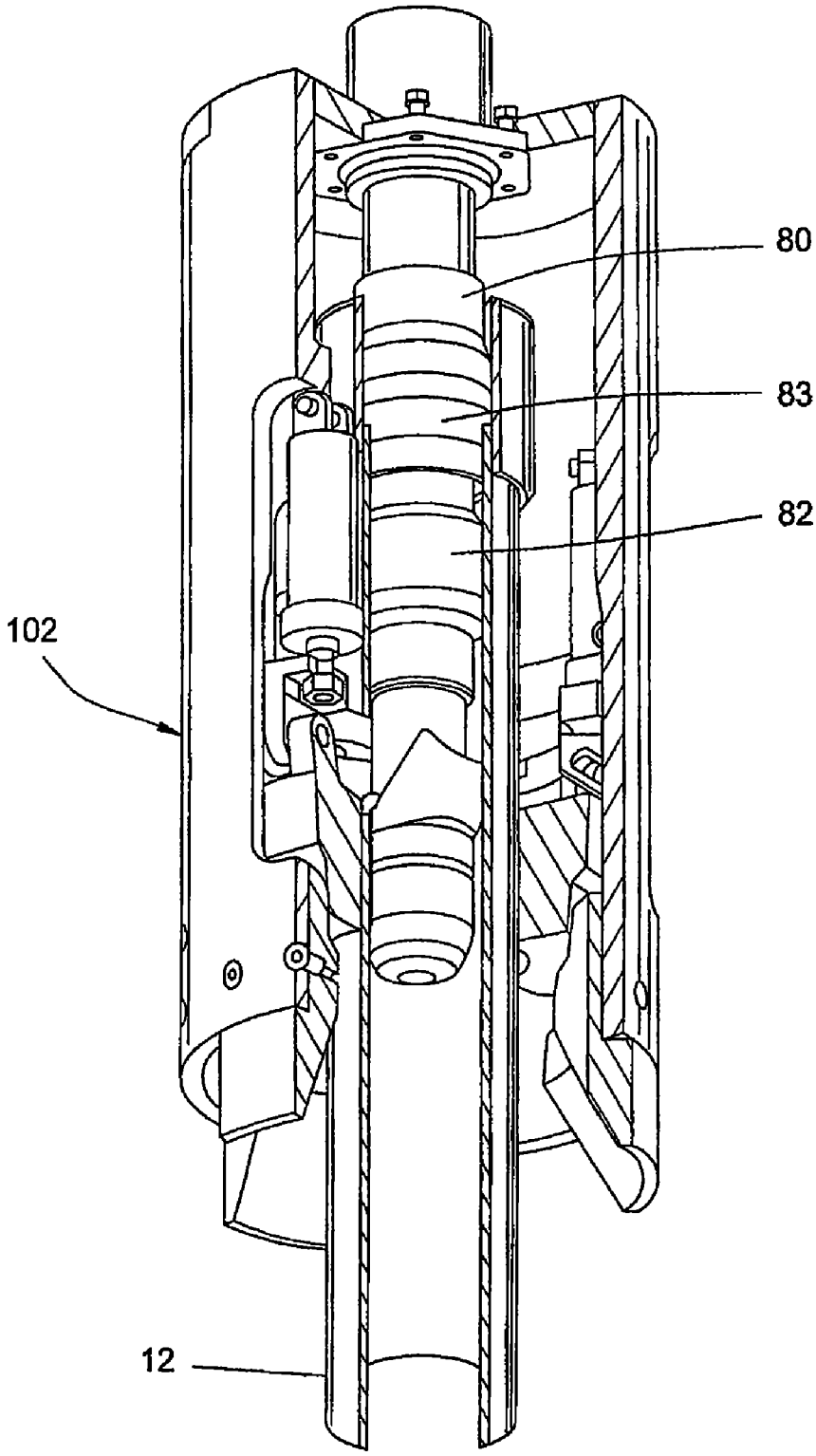
FIG. 7 is a perspective view of the torque head of FIG. 2 with 5 a circulation apparatus therein.

As shown in FIG. 7 a commercially available fillip-circulating 25 tool 80 (e.g. but not limited to a LaFleur Petroleum Services Auto Seal Circulating tool) within the torque head 100 has an end 81 inserted into the casing joint 12 when the joint 12 is being hoisted by the rig drawworks and readied for makeup to a casing string extending from the rig down into an earth wellbore. A lower packer element 82 of the tool 80 seals against the interior of the joint 12 so the joint can be filled with circulation fluid or mud. By moving the tool 80 further down within the joint 12 and sealing off the casing's interior with an upper packer element 83, circulation of drilling fluid is effected through the torque head, through the casing, and to the casing string.

As shown in FIGS. 2-7, the torque head 100 has an outer housing or barrel 102 with upper recesses 104 corresponding to projections 106 of a top plate 108. Bolts 109 bolt the top plate 108 to the housing 102. A levelling bar 110 with three sub-parts 111, 112, 113 bolted together by bolts 114 is threadedly secured to piston/cylinder apparatuses described below by pins or bolts, and the piston/cylinder apparatuses are connected to the housing 102 described below (via mounting clips). Lower sleeve portions 121, 122, 123 secured by bolts 115 to a ring 116 are spaced apart by three jaw guides 131, 132, 133 which are secured to the ring 116 (FIG. 2) by bolts 117. Jaws 141, 142, 143 each have a top member 144 positioned between ears 119 of the bar 110, each with a shaft 145 that moves in a corresponding slot 118 in the levelling bar 110 as they are raised and lowered by pistons 154 of piston/cylinder apparatuses 151, 152, 153. Lower ends of the pistons 154 are threaded for connection to part of the bar 110. Slips 160 are secured to the jaws. The controls 16 and fluid power system associated therewith or any typical rig fluid power system may be used to selectively actuate and deactivate the piston/cylinder apparatuses.

Shields 107 are bolted with bolts 105 to the housing 102. Each piston/cylinder apparatus 151, 152, 153 has flow lines 155, 156 in fluid communication with it for the selective provision of power fluid to the piston/cylinder apparatus. With a pin 157, each piston/cylinder apparatus 151-153 is connected to the housing 102, e.g. by clips.

Figure 4:
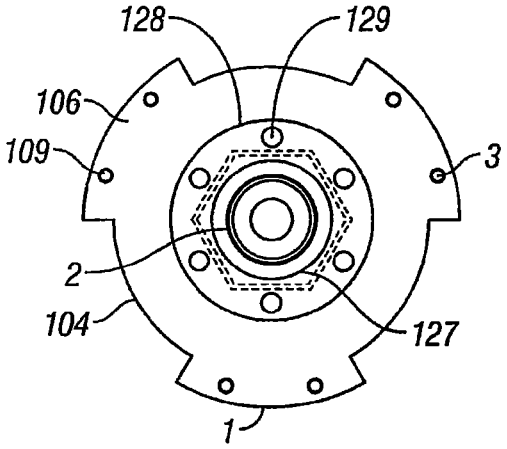
FIG. 4 is a top view of parts of the torque head of FIG. 2.
Figure 6:
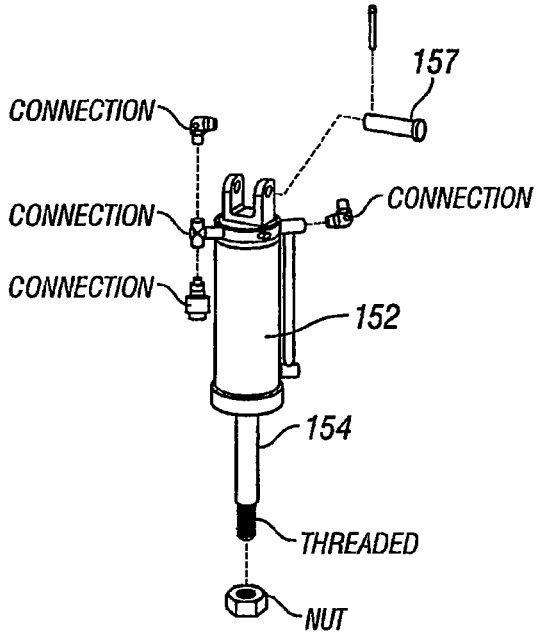
FIG. 6 is an enlarged view of a piston/cylinder device of the torque head of FIG. 2.
Figure 5:
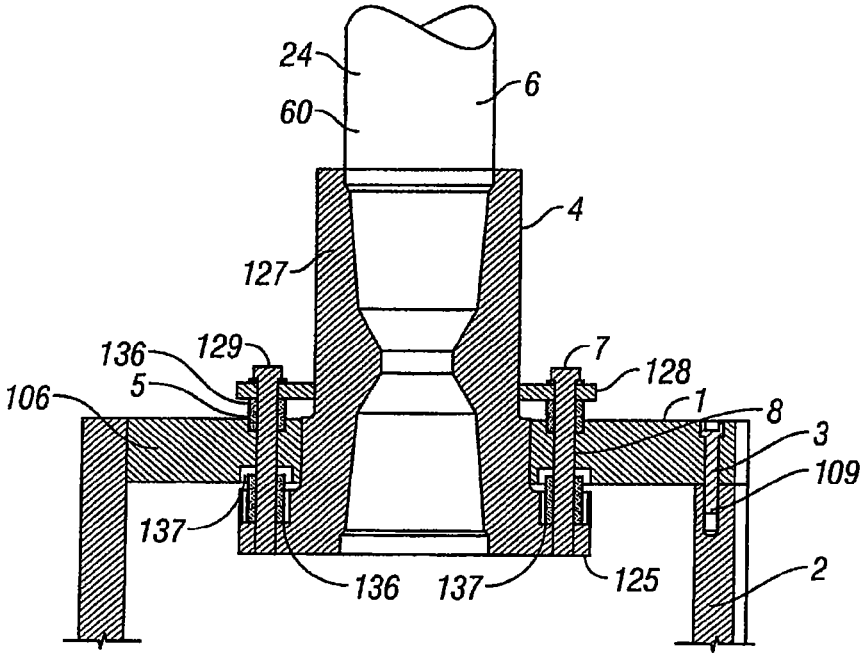
FIG. 5 is a side cross-section view of part of the torque head of FIG. 2.

The hollow top barrel 127 with a flange 128 is bolted to the top plate 106 by bolts 129. Optionally, the top barrel 127 may be mounted to the housing 102 as shown in FIGS. 4 and 5 with bolts 129 extending through the flange 128 with suitable washers or springs 136, e.g. but not limited to belleville springs, around each bolt. Each bolt 109 extends down into a lower flange 125 of the top barrel 127. Of course it is within the scope of this invention to have the top barrel 127 yieldably and movably mounted to the top plate 106 with any suitable fasteners (screws, bolts, rivets, or studs and to use any suitable spring(s) or spring apparatus(es) between the top barrel 127 and plate 106 to provide a desired degree of axial movement between these two items. This in turn permits controlled relative axial movement of the torque head relative to the casing due to the movement of the dies with respect to the slips 160. Some of the belleville springs 136 are in recesses 137 in the plate 106.

Figure 3:
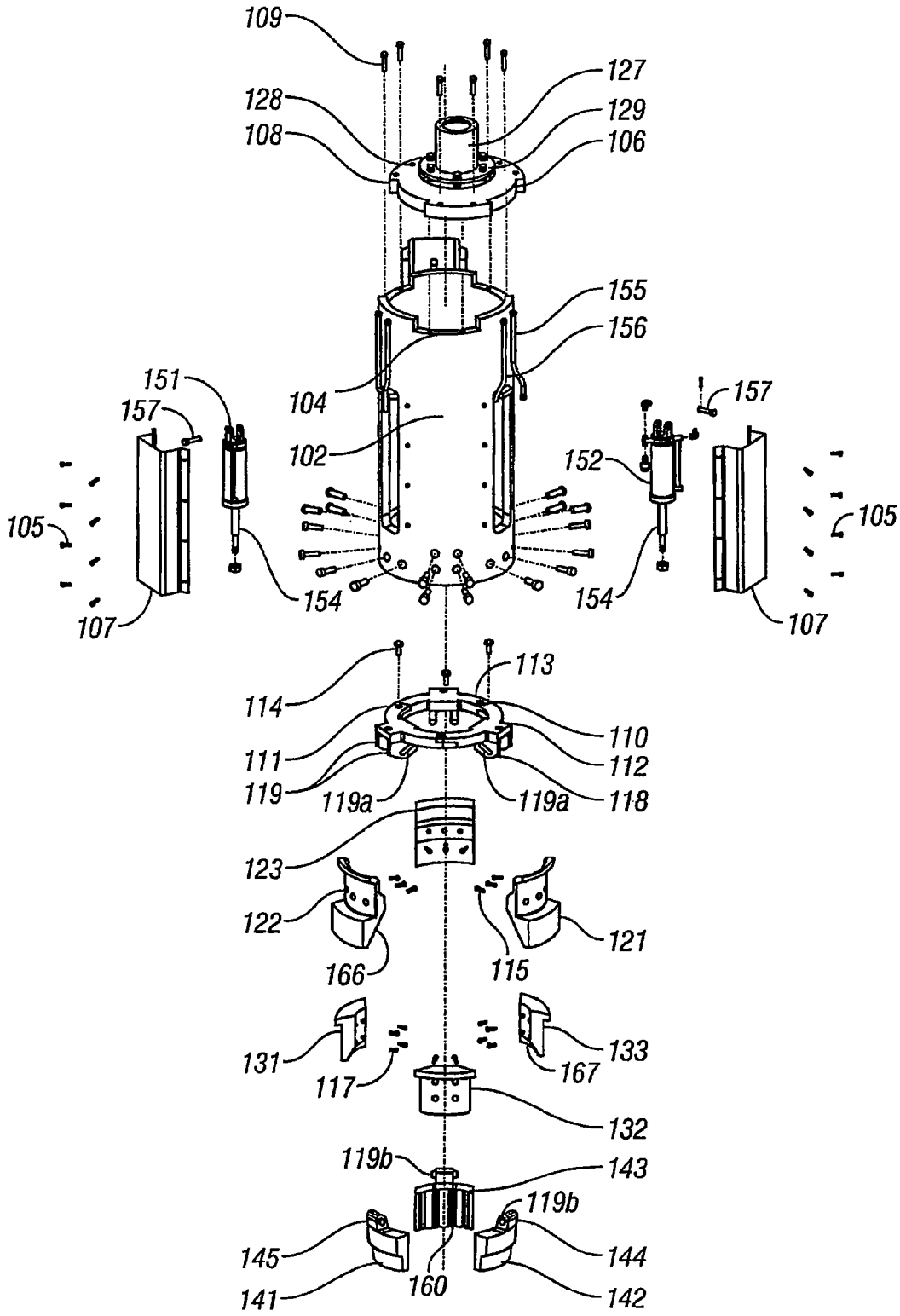
FIG. 3 is an exploded view of the torque head of FIG. 2.

As shown in FIG. 3, the lower sleeves each has an inclined portion 166 that facilitates entry of a top of a casing joint into the torque head 100. Each jaw guide also has an inclined portion 167 that facilitates entry of a top of a casing joint into the torque head 100. Each lower sleeve 121-123 is positioned behind one of the pairs of ears 119 of the levelling bar 110 and serves as a back up or stop for each jaw. Cam followers **119*b* are attached to the slips and mounted in oblique slots 119*a*** on the levelling bar free oblique motion of the slips relative to the sleeves.

Lines 155, 156 in fluid communication with a system (not shown) for selectively providing fluid under pressure, e.g. a typical rig fluid pressure system. The lines connect the hydraulic actuating cylinders to an hydraulic rotating swivel union 206 (see FIG. 11) which allows hydraulic fluid to be distributed to the cylinders as they rotate with the top drive spindle or quill. The rotating swivel union 206 permits the cylinders to rotate without twisting the hydraulic lines. The cylinders are controlled by a remotely located selector valve (item 222, FIG. 11).

Figure 11:
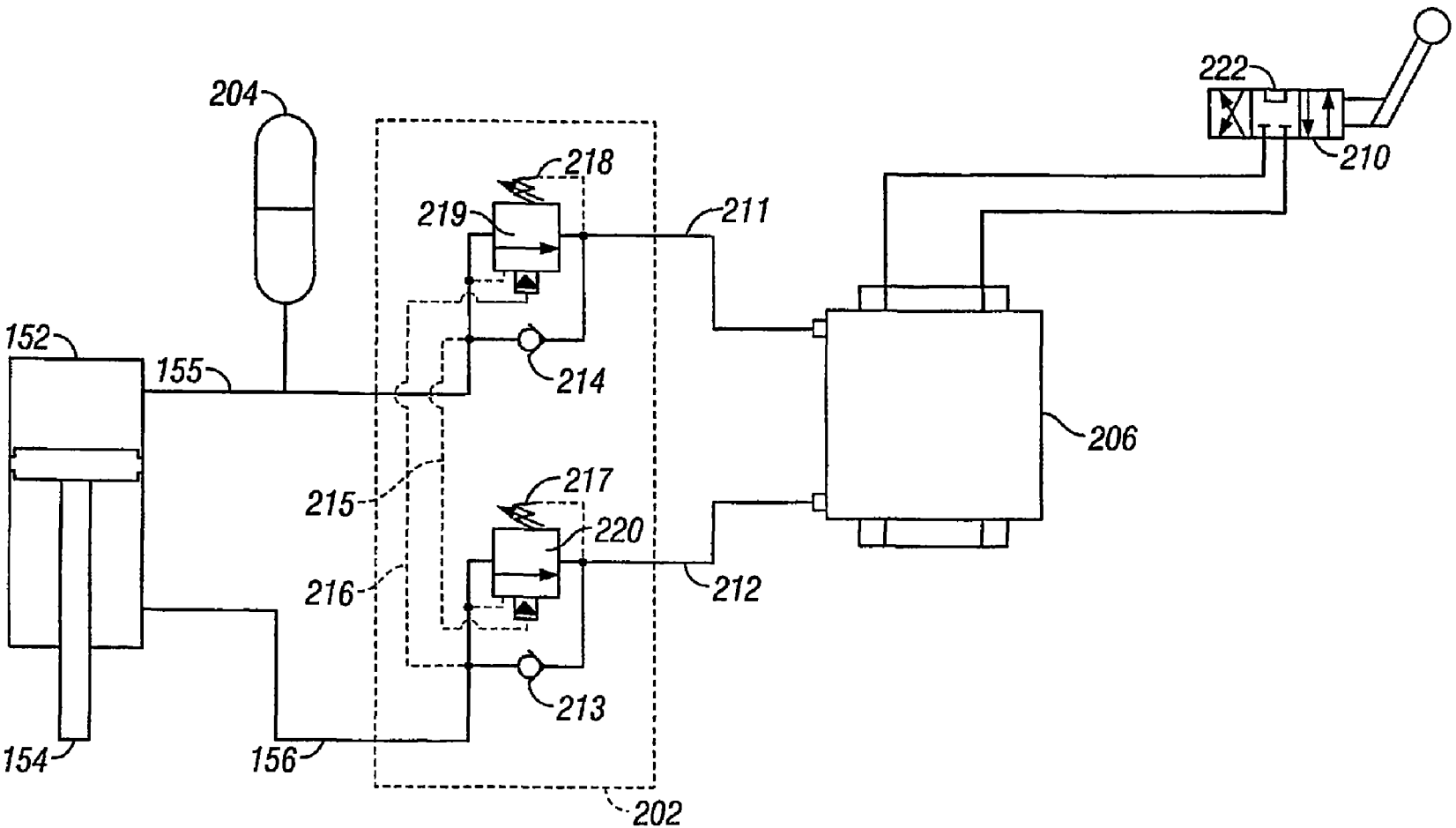
FIG. 11 is a schematic view of a hydraulic circuit useful 10 with a torque head and system according to the present invention.

FIG. 11 shows a fluid control circuit 200 according to the present invention for each piston/cylinder apparatus 151-153. A pair of pilot operated check valves 218, 220 sense a pilot pressure via lines 215 and 216. If the pressure goes below a preset amount, the valves close off lines 155, 156 thereby holding the hydraulic fluid under pressure therein and preventing the pistons 154 from moving. Thus the jaws 141-143 are held in engagement against a casing with a portion in the torque head 100. An accumulator 204 maintains fluid under pressure to provide makeup hydraulic fluid and maintain pressure on the cylinders (e.g. if fluid is lost due to seal damage leakage). Flow to and from the rotary at this swivel union 206, valve 202, accumulator 204, and piston/cylinder apparatuses 151-153 is controlled by a typical multi-position valve (e.g. but not limited to, a three position, two way, open center valve) and control apparatus 210 which can be manually or automatically activated.

Figure 10:
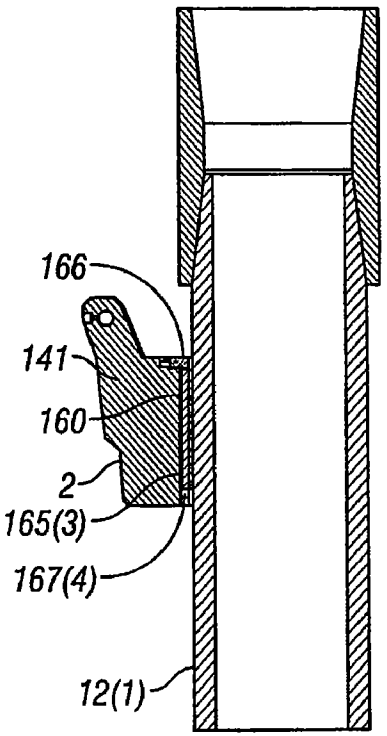
FIGS. 8, 9 and 10 are side views in cross-section showing operation of a slip according to the present invention.
Figure 9:
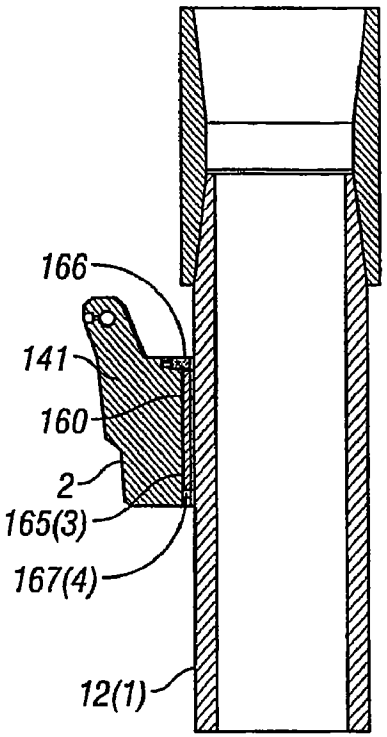
Figure 8A:
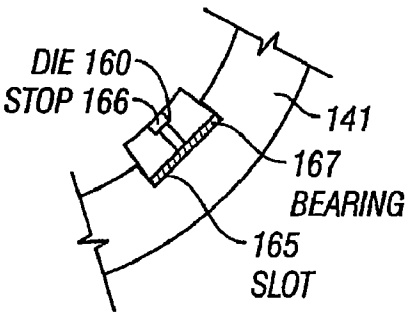
FIG. 8A is a cross-section view of part of FIG. 8.
Figure 8:
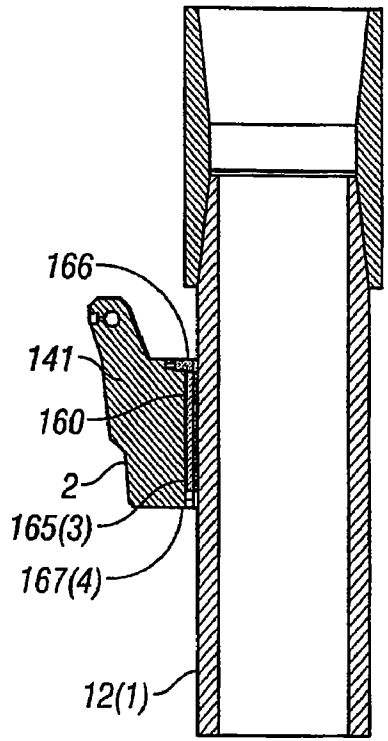

FIGS. 8-10 illustrate movement of the slips 160 with respect to the jaws 141-143 (and thus the possible relative movement of a tubular such as casing relative to the torque head). The controlled movement of these slips 160 permits controlled axial movement between the jaws and casing engaged thereby. The slips are engaged and disengaged by means of the hydraulic actuating cylinders. However, some relative vertical movement of the dies with respect to the slips may occur with vertical movement of the top drive, but this is limited by stops 166 at the top and bottom of the die grooves in the slips. Optionally, a member or bearing insert 167 made of material with a low coefficient of friction, (e.g. but not limited to, thermoplastic material, or carbon fiber, reinforced resin compound material) is positioned between the inner jaw surface and the outer slip or die surface. In one particular aspect these inserts are about one-eighth inch thick. Each slip 160 can move in a groove 165 in the jaws. Removable bolts or screws 166 prevent the slips 160 from escaping from the grooves 165. As shown in FIG. 8, the slip 160 is near yet not engaging an exterior surface of the casing 12. The slip 160 is at the bottom of its groove 165. As shown in FIG. 9, the slip 160 has made initial contact between the slip 160 and casing 12 (the jaw 141 has moved down and radially inwardly). The slip 160 is still at the bottom of the groove 165 and the member 167 provides a bias so that the slip 160 remains fixed in position relative to the casing 12 and jaw 141 and the jaw 141 continues to move down. In certain preferred embodiments, the teeth of the die insure that the frictional forces between the die and casing is significantly higher than the frictional force between the die and slip (due to the material of lower friction coefficient) so that the die is biased to move upward relative to the slip and not the casing as the slip is engaged and is biased to move downward relative to the slip as the slip is moved upward or retracted.

As shown in FIG. 10 the jaw 141 and slip 160 have engaged the 10 casing 12, the jaw 141 has moved further downwardly, and the slip 160 has moved to the top of the groove 165. Such a position of 14, the slip 160, and jaw 141 (and a similar position of the other slips and jaws) prevents lockup or allows recovery from it.

FIGS. 12-16 show steps in a method according to the present invention using a system according to the present invention as described herein, e.g. but not limited to a system as shown in FIGS. 1-11. It is to be understood that in these figures the top drive system is mounted to a typical rig or derrick (not shown).

Figure 12:
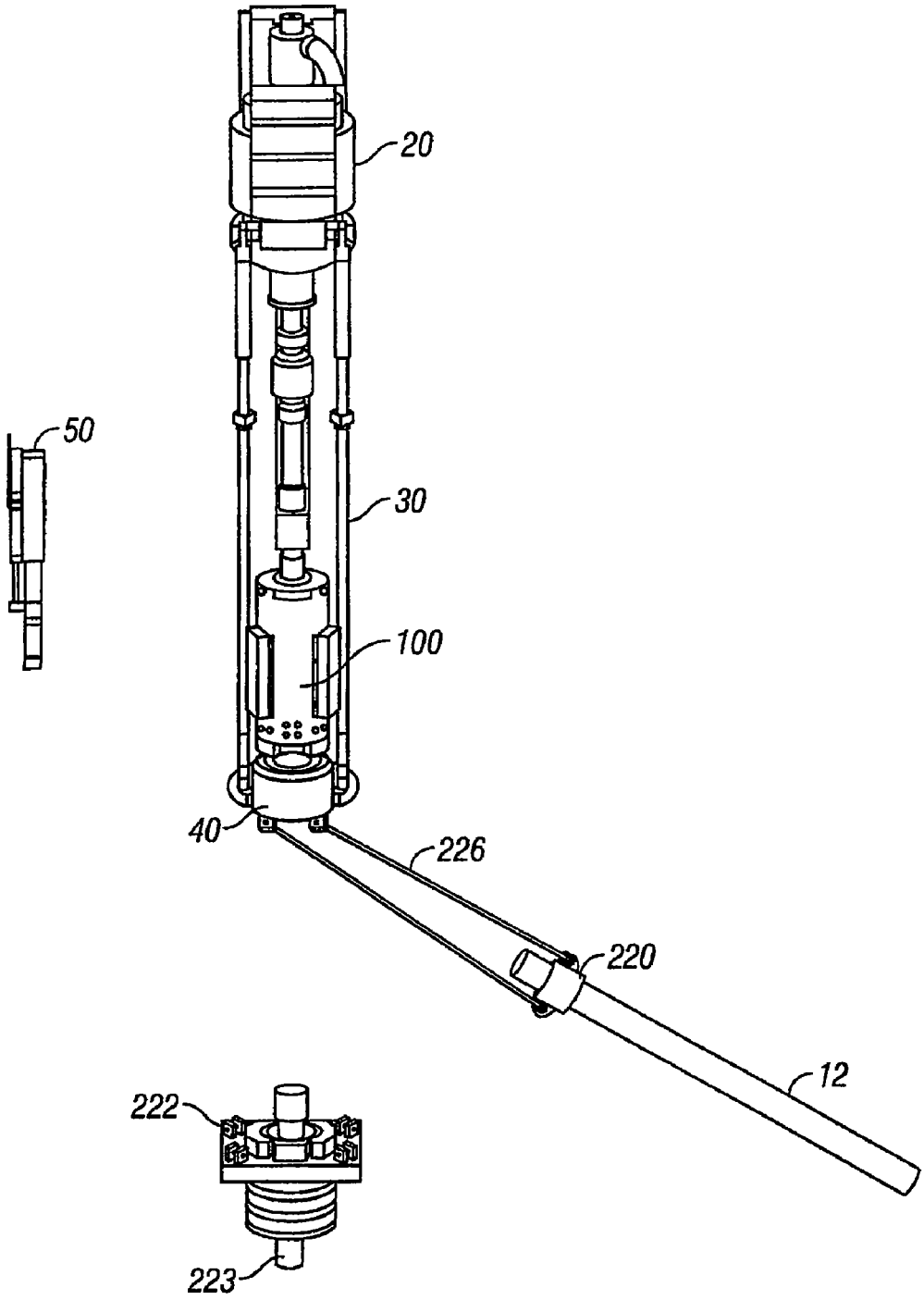
FIGS. 12-16 are side views of steps in a method using a system according to the present invention.

As shown in FIG. 12, a single joint elevator 220 has been secured around a casing joint 12 which is to be added to a casing string 223 that extends down into a wellbore W in the earth. A spider 222 (e.g. but not limited to a flush mounted spider) engages and holds a top part of a top casing joint of the string 223. It is within the scope of this invention to employ any suitable spider and single joint elevator. (Instead of the spider 222 any suitable known clamping or gripping apparatus or device may be used according to the present invention.) Also, optionally, a joint compensator 224 may be used positioned as desired, e.g. but not limited to between the torque head and the top drive. The pipe handler 50 has been lowered.

Figure 13:
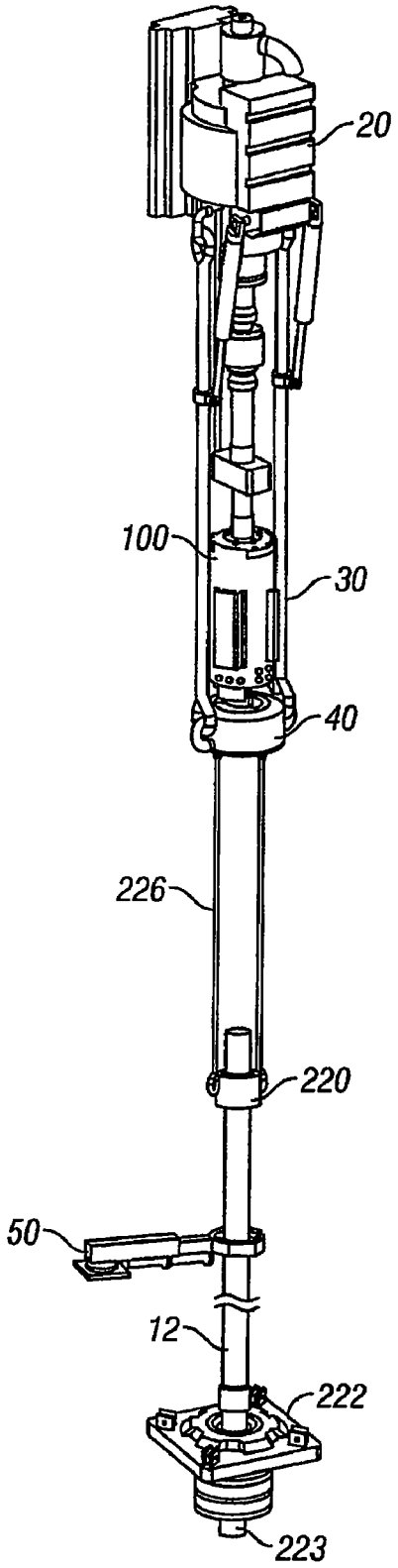
Figure 14:
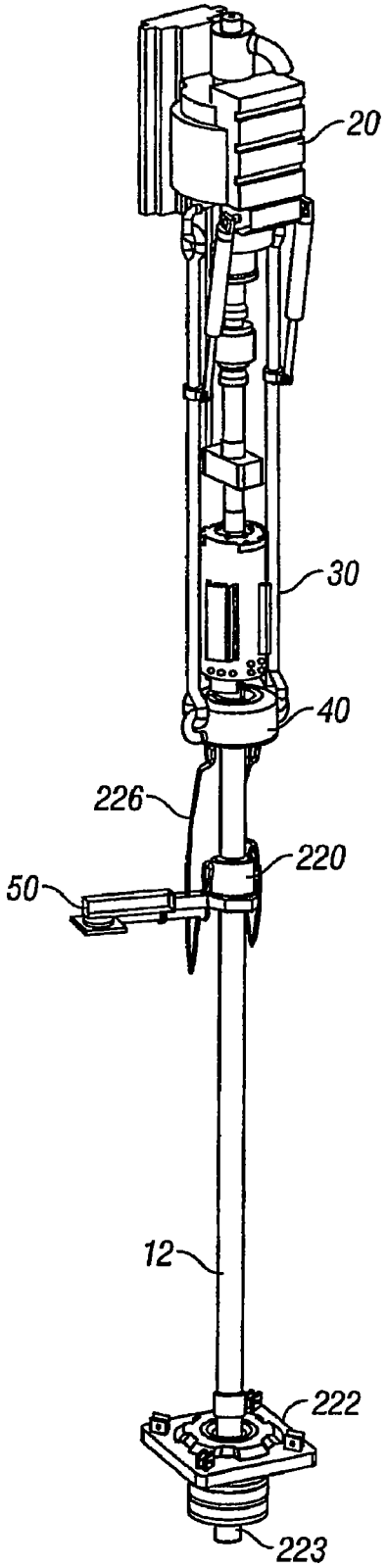

As shown in FIG. 13, the top drive 20 has been raised by the drawworks D (shown schematically) in a derrick of a rig (not shown) and the lower end of the casing 12 has been positioned above the string 223. In FIG. 14, the torque head 100 has been lowered (by lowering the top drive 20 with the drawworks D) by lowering the top drive 20 so that the elevator 40 encompasses the casing 12 and the jaws of the torque head encompass a top portion of the casing 12. The pipe handler 50 has been raised to engage the casing 12 below the elevator 220 to facilitate correct positioning of the casing 12 with respect to the top of the string 223.

Figure 15:
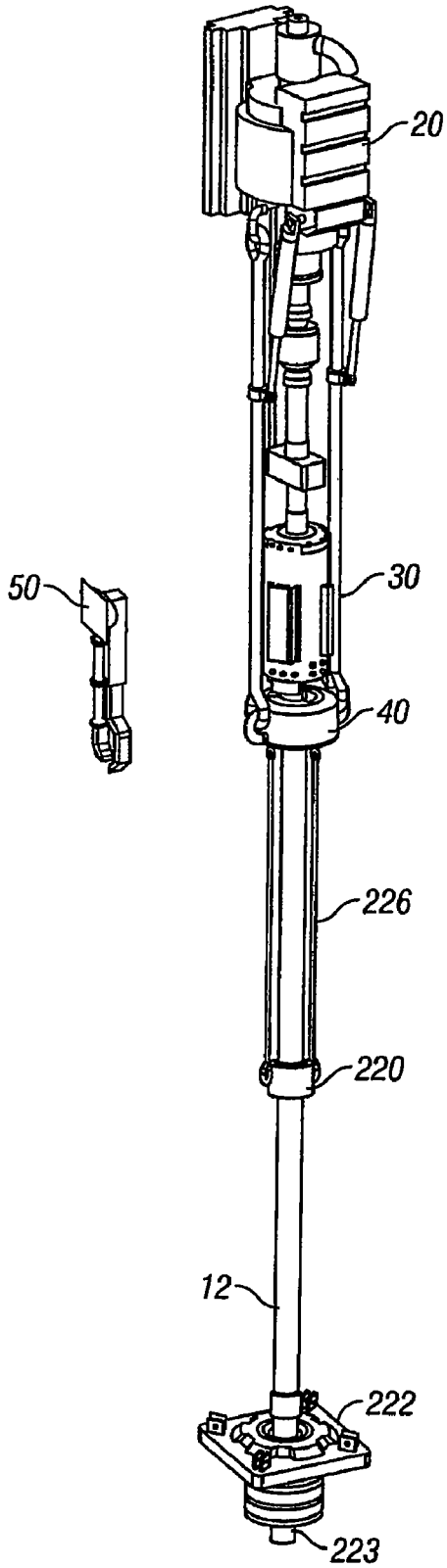
Figure 16:
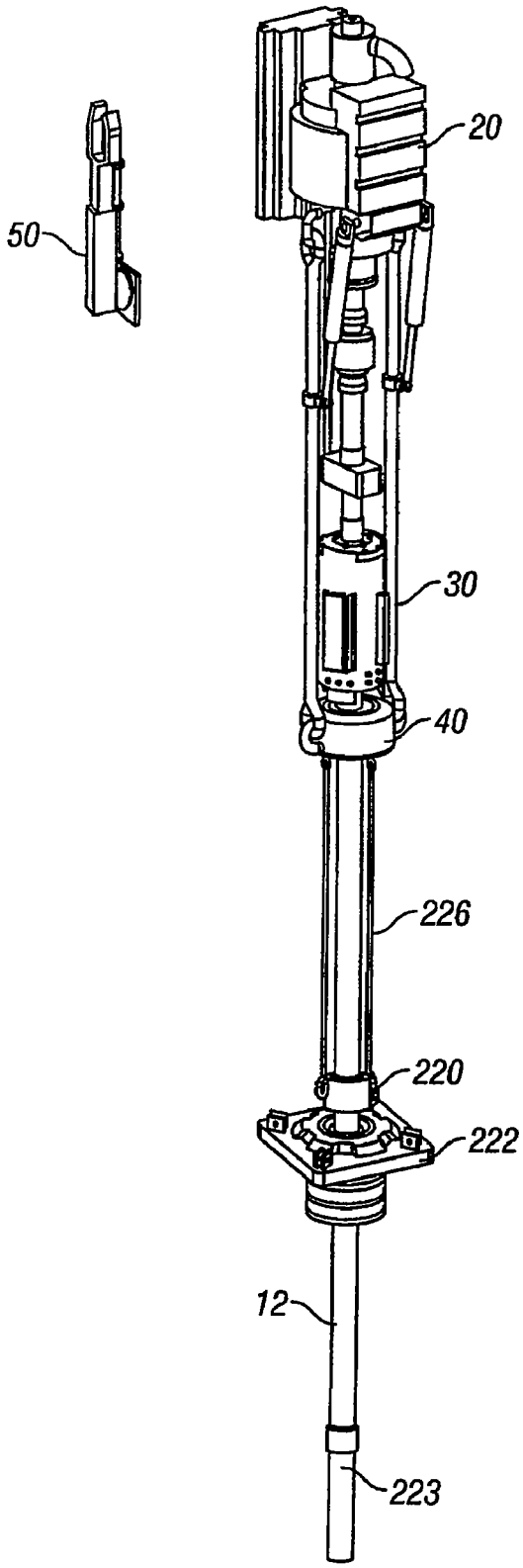
Figure 17:
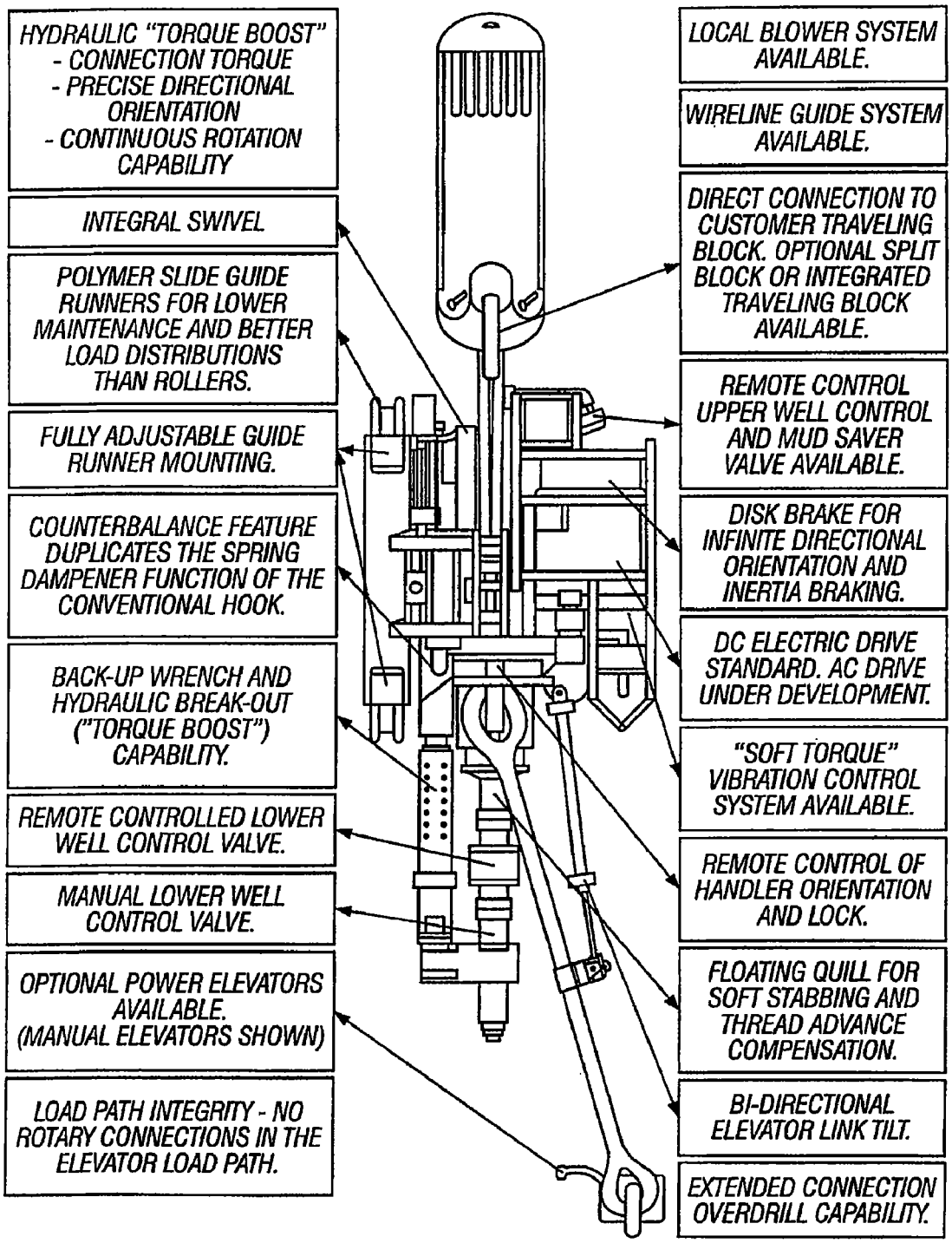
FIG. 17 is a side view of a prior art top drive system.

As shown in FIG. 15 the jaws of the torque head 100 have engaged the casing 12 to rotate it and the pipe handler 50 has been retracted and lowered out of the way. The top drive 20 has begun to slowly rotate the torque head 100 and, thus, the casing 12 to find the threads in the top joint of the string 223 and then, increasing the rate of rotation, to makeup the new connection. Then (see FIG. 16) the torque head jaws are released, the elevator 40 is activated to engage the casing and slips in the elevator move down to engage the casing; the spider 222 is released, and the top drive 20 is lowered with the drawworks D to lower the entire string 223. Then the spider 222 is re-set to engage the casing 12 and the procedure begun in FIG. 12 is repeated to add another joint to the string.

Figure 18:
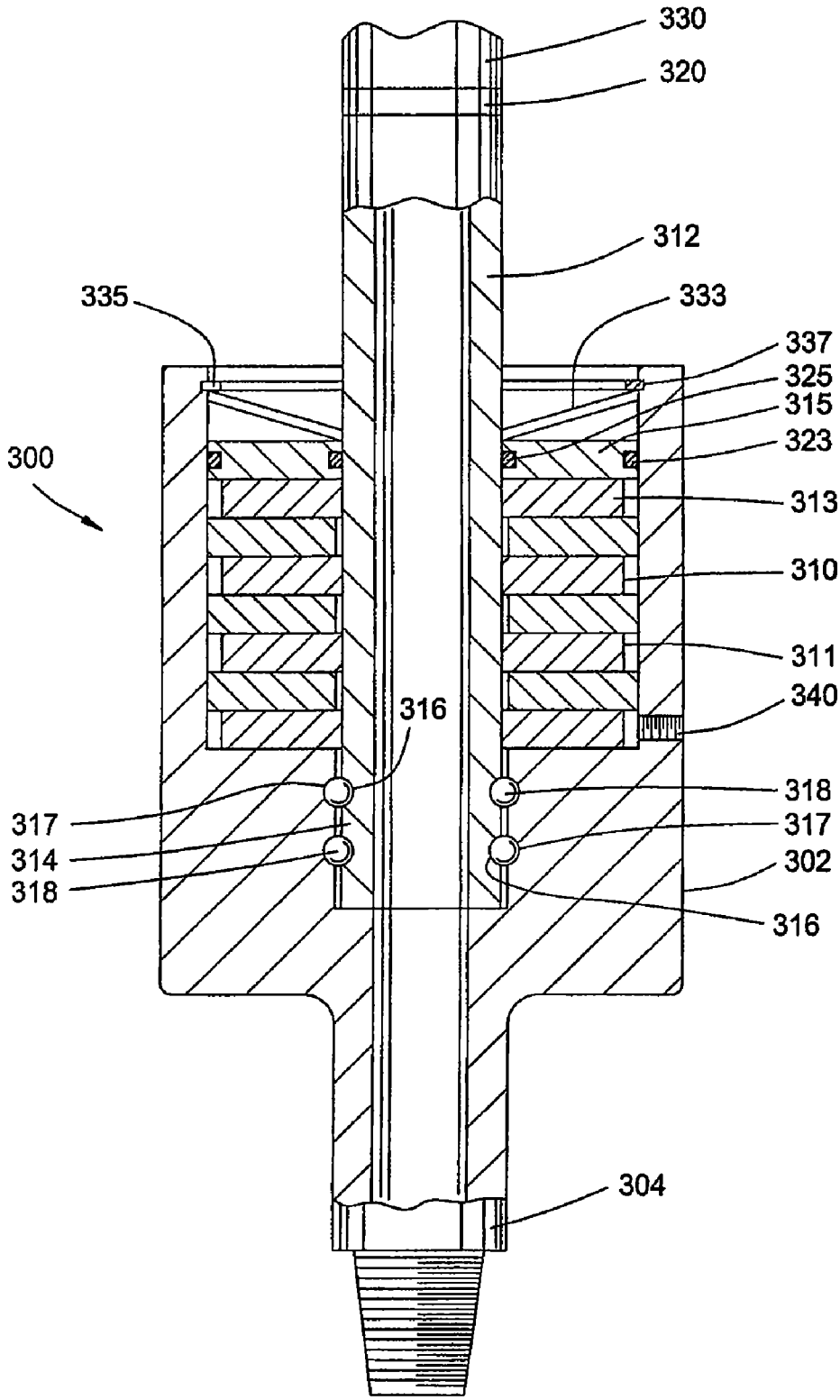
FIG. 18 is a side view in cross-section of a top drive casing 15 system coupler.

FIG. 18 shows a top drive coupler 300 according to the present invention with a body 302 that houses a clutch apparatus 310. The body 302 has a lower threaded end 304. An input shaft 312 has a lower end 314 with bearing recesses 316 for bearings 318 a portion of which also resides in the recesses 317 of the body 302.

The clutch apparatuses 310 has a plurality of spaced-apart clutch plates 311 connected to the housing 302 (e.g. with a splined connection) and a plurality of spaced-apart clutch plates 313 connected to the input shaft 312. In certain aspects one set or the other of the clutch plates is covered with friction material, e.g. but not limited to typical brake and clutch lining materials. A piston 315 with edge O-ring seals 323, 325 is sealingly disposed above the top most clutch plate 313 in the interior space defined by an outer surface of the shaft 312 and an inner surface of the body 302. A spring apparatus 333 urges the piston 315 down, energizing the clutch. A snap ring 335 with a portion in a recess 337 of the body 302 holds the spring apparatus 333 in place. In one aspect the apparatus 333 is one or more belleville springs. FIG. 18 shows schematically a coupling 320 connected to or formed integrally of the shaft 312 and a top drive 330 connected releasably to the coupling 320. The coupler 300 provides for the selective rotation of an item connected beneath it by the selective engagement of the clutch apparatus and may be used, e.g., with any top drive casing make-up system, including those according to the present invention. A coupler 300 may be used to selectively increase, reduce, or stop the transmission of torque from the top drive to the torque head and/or other top drive driven devices, e.g. but not limited, tubular torque transmission devices; milling apparatuses and systems; drilling apparatuses and systems; and/or external or internal tubular gripping devices. A coupler 300 may be used with a power swivel. Through a channel 340 is selectively provided fluid under pressure (e.g. from a typical rig system or from a rig joint make-up monitor system) to deenergize the apparatus 300, e.g., just prior to an indication of the shouldering of a joint. Alternatively, to effect deenergizing, the spring apparatus 333 is deleted and the channel 340 is placed so that fluid is applied on top of the piston (with some seal member above the plates).

The present invention, therefore, provides in certain, but not necessarily all embodiments, a torque head for gripping a tubular member (e.g. but not limited to casing that is part of a casing string), the torque head with a housing, and grip mechanism within the housing for selectively gripping a tubular member within the housing; such a torque head wherein the grip mechanism is able to grip the tubular member and exert both axial and torsional forces on the tubular member while it is gripped; and/or such a torque head with a top drive connected to the torque head.

Provided, therefore, in certain aspects, a torque head with a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable. Such a torque head may have one, some, any combination of, or all the following: wherein the die apparatus is movably upwardly as the portion of the tubular is engaged and downwardly as the portion of the tubular is disengaged; a bearing insert disposed between the die apparatus and the at least one jaw for facilitating movement of the die apparatus with respect to the at least one jaw; wherein the bearing insert is made from thermoplastic material or carbon-fiber reinforced resin compound; the die apparatus positioned in a recess in the at least one jaw, and a stop member secured to the at least one jaw with a portion thereof projecting into the recess of the at least one jaw for limiting movement of the die apparatus and for preventing escape of the die apparatus from the recess; releasable connection apparatus for releasably connecting the torque head to another item; the releasable connection apparatus including a top plate mounted to a top of the housing, a top barrel mounted to the top plate, and the top barrel mounted to the top plate with shear bolts shearable in response to a predetermined load for selective separation of the top barrel from the top plate; wherein there is spring apparatus between the top barrel and the top plate providing for limited axial movement of the top barrel with respect to the top plate; a piston-cylinder apparatus interconnected between the at least one jaw and the housing for selectively moving the at least one jaw into and out of engagement with the portion of the tubular member; guide apparatus connected to the at least one jaw for guiding movement of the at least one jaw fluid circulation apparatus for selectively continuously providing fluid to a tubular member gripped by the torque head; wherein the tubular member is connected to a tubular string extending downwardly from the torque head and the fluid circulation apparatus circulates fluid to the tubular string during operation of the torque head; at least one lower member secured at the bottom of the housing with an inclined portion for facilitating entry of a tubular member into the housing; wherein the at least one lower member is a plurality of spaced-apart lower members; and/or wherein the at least one jaw is a plurality of spaced-apart jaws.

The present invention, therefore, provides in certain, but not necessarily all embodiments, a torque head for gripping tubular members, the torque head with a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, wherein the die apparatus is movably upwardly as the portion of the tubular is engaged and downwardly as the portion of the tubular is disengaged, a bearing insert disposed between each die apparatus and each jaw for facilitating movement of the die apparatus with respect to the jaw, and releasable connection apparatus for releasably connecting the torque head to another item. Such a torque head may have one, some, any combination of, or all the following: torque head may have a top drive releasably secured to and above it.

The present invention, therefore, provides in certain, but not necessarily all embodiments, a torque head for gripping tubular members, the torque head with a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable, and releasable connection apparatus for releasably connecting the torque head to another item; a top plate mounted to a top of the housing, a top barrel mounted to the top plate, and the top barrel mounted to the top plate with shear bolts shearable in response to a predetermined load for selective separation of the top barrel from the top plate; wherein there is spring apparatus between the top barrel and the top plate providing for limited axial movement of the top barrel with respect to the top plate; fluid circulation apparatus for selectively continuously providing fluid to a tubular member gripped by the torque head; and/or a top drive releasably secured to and above the torque head.

The present invention, therefore, provides in certain, but not necessarily all embodiments, a top drive system with a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable; and such a top drive system including pipe handler apparatus disposed beneath the elevator apparatus.

The present invention, therefore, provides in certain, but not necessarily all embodiments, a top drive system with a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasably connecting the torque head to another item; and such a top drive system including pipe handler apparatus disposed beneath the elevator apparatus.

The present invention, therefore, provides in certain, but not necessarily all embodiments, a method for connecting a first tubular member to a second tubular member, the method including engaging the first tubular member with a first elevator secured to and beneath a second elevator, the second elevator comprising a component of a top drive system, the top drive system comprising a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable, lifting the first tubular member above the second tubular member, the second tubular member held in position by a spider, lowering the top drive system so an upper end of the first tubular member enters the torque head and gripping said upper end with the torque head, lowering with the top drive the first tubular member so that a lower threaded end thereof enters an upper threaded end of the second tubular member, and rotating the first tubular member with the top drive to threadedly connect the first tubular member to the second tubular member; such a method including facilitating positioning of the first tubular member with pipe handling apparatus selectively engaging the first tubular member; such a method wherein the top drive is movably mounted in a rig and the spider is a flush mounted spider on a rig floor; such a method wherein the second tubular member is a top tubular of a tubular string extending down into earth; and/or such a method wherein the tubular members are casing.

The present invention, therefore, provides in certain, but not necessarily all embodiments, a method for disconnecting a first tubular member from a second tubular member, the method including engaging a top end of the first tubular member with a torque head of a top drive system, the top drive system comprising a top drive bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted thereto, the die apparatus movable with respect to the at least one jaw so that relative movement of the tubular with respect to the torque head is possible to the extent that the die apparatus is movable, rotating the first tubular with the top drive to disconnect the first tubular from the second tubular.

The present invention, therefore, provides in certain, but not necessarily all embodiments, a method for connecting a first tubular member to a second tubular member, the method including engaging the first tubular member with a first elevator secured to and beneath a second elevator, the second elevator comprising a component of a top drive system, the top drive system comprising a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasably connecting the torque head to another item, lifting the first tubular member above the second tubular member, the second tubular member held in position by a spider, lowering the top drive system so an upper end of the first tubular member enters the torque head and gripping said upper end with the torque head, lowering with the top drive the first tubular member so that a lower threaded end thereof enters an upper threaded end of the second tubular member, and rotating the first tubular member with the top drive to threadedly connect the first tubular member to the second tubular member.

The present invention, therefore, provides in certain, but not necessarily all embodiments, a method for disconnecting a first tubular member from a second tubular member, the method including engaging a top end of the first tubular member with a torque head of a top drive system, the top drive system comprising a top drive, bails connected to and extending beneath the top drive, elevator apparatus connected to a lower end of the bails, wrenching apparatus interconnected with the top drive and positioned therebeneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasably connecting the torque head to another item, and rotating the first tubular with the top drive to disconnect the first tubular from the second tubular.

The present invention, therefore, provides in certain, but not necessarily all embodiments, a coupler device for coupling a torquing device to an item to be rotated thereby, the coupler device with a body with a first end and a second end, a recess in the first end of the body, a shaft with a shaft first end and a shaft second end, at least part of the shaft within the recess of the body, a clutch apparatus in the recess of the body, and clutch energizing apparatus for energizing the clutch apparatus; clutch deenergizing apparatus for deenergizing the clutch apparatus; and/or such a coupler device with the clutch apparatus having a plurality of spaced-apart shaft clutch plates connected to the shaft and projecting out therefrom into the recess of the body, a plurality of spaced-apart body clutch plates connected to and projecting inwardly into the recess of the body, and the plurality of spaced-apart shaft clutch plates interleaved with the plurality of spaced-apart body clutch plates.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

The invention claimed is:

1. An apparatus for making up casings, comprising:

a rotational device disposable above a rig floor;

a gripping member operatively connected to the rotational device, the gripping member having one or more radially extendable elements for gripping a first casing;

a torque measuring device for measuring torque developed within a threaded connection as the first casing is rotated into threaded engagement with a second casing;

a torque wrench coupled to and disposed above the torque measuring device; and a controller for controlling the rotational device in response to a torque measured by the torque measuring device prior to an indication of shouldering between the threaded engagement of the first casing and the second casing.

2. The apparatus of claim 1, further comprising a thread compensator coupled to the gripping member.

3. The apparatus of claim 2, further comprising a fluid path through the thread compensator and the gripping member.

4. The apparatus of claim 1, wherein the gripping member applies an axial force and a torsional force to the first casing.

5. The apparatus of claim 1, wherein the rotational device is de-energized when the measured torque reaches a predetermined torque.

6. The apparatus of claim 1, wherein the rotational device comprises a top drive.

7. The apparatus of claim 1, wherein the torque measuring device is operatively located between the rotational device and the gripping member.

8. The apparatus of claim 1, further comprising a joint make-up monitoring system.

9. The apparatus of claim 1, wherein the gripping member comprises slips.

10. The apparatus of claim 1, wherein the torque measuring device is a torque sub.

11. The apparatus of claim 1, further comprising a fluid fill-up circulation tool connected to the gripping member.

12. The apparatus of claim 1, wherein the rotational device includes a coupler operable to selectively transmit torque from the rotational device.

13. The apparatus of claim 12, wherein the controller is operable to de-energize the coupler to adjust the torque from the rotational device.

14. The apparatus of claim 1, further comprising a swivel.

15. A method for making a threaded connection between a first casing and a second casing on a rig, comprising:

providing a rotational device, a torque wrench, and a torque measuring device disposed below the torque wrench, each operatively connected to the rig;

providing a gripping member having radially movable gripping elements for gripping the first casing;

gripping the first casing with the gripping elements;

aligning the first casing with respect to the second casing;

operating the rotational device, thereby rotating the gripping member and the first casing and thereby inter-engaging the first and second casings;

measuring a torque developed at the inter-engaging first and second casings during make-up using the torque measuring device; and controlling the rotational device to adjust the torque in response to the measured torque and prior to an indication of shouldering between the first and second casings.

16. The method of claim 15, further comprising inserting a circulating tool into the first casing.

17. The method of claim 15, wherein the torque measuring device is a torque sub.

18. The method of claim 15, further comprising rotating the first casing after adjustment of the torque.

19. The method of claim 15, further comprising de-energizing the torque prior to the indication of shouldering.

20. The method of claim 15, further comprising continuing to make-up the inter-engaging first and second casings at the adjusted torque.

* * * * *